US007044036B1

(12) United States Patent
Salazar et al.

(10) Patent No.: US 7,044,036 B1
(45) Date of Patent: May 16, 2006

(54) PRESET TORQUE WRENCH WITH MULTIPLE SETTING TORQUE SELECTOR MECHANISM

(75) Inventors: Eduardo Salazar, Rancho Cucamonga, CA (US); Brian Cutler, Rowland Heights, CA (US)

(73) Assignee: Snap-on Incorporated, Pleasant Prairie, WI (US)

( * ) Notice: Subject to any disclaimer, the term of this patent is extended or adjusted under 35 U.S.C. 154(b) by 0 days.

(21) Appl. No.: 10/976,947

(22) Filed: Oct. 29, 2004

Related U.S. Application Data

(60) Provisional application No. 60/516,065, filed on Oct. 31, 2003.

(51) Int. Cl.
*B25B 23/159* (2006.01)

(52) U.S. Cl. ..... 81/483; 81/478; 81/480

(58) Field of Classification Search ..... 81/483, 81/478, 480, 481, 467, 473, 476
See application file for complete search history.

(56) References Cited

U.S. PATENT DOCUMENTS

| | | | | |
|---|---|---|---|---|
| 2,792,733 | A | 5/1957 | Walraven et al. | |
| 2,887,921 | A | 5/1959 | Livermont | |
| 3,608,403 | A | 9/1971 | Green | |
| 3,742,786 | A | 7/1973 | Krain | |
| 4,207,783 | A * | 6/1980 | Grabovac | 81/483 |
| 4,403,531 | A | 9/1983 | Bailey et al. | |
| 4,485,703 | A * | 12/1984 | Grabovac et al. | 81/483 |
| 4,541,313 | A | 9/1985 | Wise | |
| 4,655,104 | A | 4/1987 | Blattner | |
| 4,870,879 | A * | 10/1989 | Shieh | 81/483 |
| 4,901,610 | A | 2/1990 | Larson et al. | |
| 5,503,042 | A * | 4/1996 | Larson et al. | 74/527 |
| 5,546,816 | A * | 8/1996 | Jansson et al. | 73/862.21 |
| 5,859,371 | A * | 1/1999 | Hsieh | 73/862.23 |
| 6,076,439 | A | 6/2000 | Dzieman | |
| 6,155,147 | A | 12/2000 | Dzieman | |
| 6,334,377 | B1 | 1/2002 | Wu | |
| 6,568,283 | B1 | 5/2003 | Fanguy | |
| 6,640,674 | B1 | 11/2003 | Rinner et al. | |
| 6,722,235 | B1 * | 4/2004 | Hsieh | 81/478 |

* cited by examiner

*Primary Examiner*—Lee D. Wilson
*Assistant Examiner*—Alvin J Grant
(74) *Attorney, Agent, or Firm*—Seyfarth Shaw LLP

(57) ABSTRACT

A torque wrench has an elongated lever arm with working and distal ends, the lever arm carrying a wrench head at the working end, a selector mechanism at the distal end and a torque-responsive mechanism coupled to the selector mechanism for movement therewith among plural selectable positions respectively corresponding to preset torque values, the lever arm having a longitudinal axis and an outer surface spaced transversely from the axis no more than a maximum transverse distance, the selector mechanism including retaining mechanism disposed axially beyond the distal end of the lever arm and spaced transversely from the axis a distance greater than the maximum transverse distance for retaining the selector mechanism in a selected position.

5 Claims, 5 Drawing Sheets

PRESET TORQUE WRENCH WITH MULTIPLE SETTING TORQUE SELECTOR MECHANISM

RELATED APPLICATIONS

This application claims the benefit of the filing date of U.S. provisional application Ser. No. 60/516,065, filed Oct. 31, 2003.

This application describes an improvement of the torque wrench disclosed in copending U.S. application Ser. No. 10/368,909, filed Feb. 17, 2003, and entitled "Torque Wrench With Finite Plurality of Selectable Torque Values", the disclosure of which is incorporated herein by reference.

BACKGROUND

The aforementioned copending application Ser. No. 10/368,909 describes a torque wrench which includes selector mechanism for manually selecting any of a number of different preset torque values, and for latching the selector mechanism in the selected value position, so that the selector mechanism cannot accidentally be moved during use of the wrench, thereby inadvertently changing the preset torque value. The selector mechanism includes a locking structure which fits inside the tubular lever arm of the wrench and has a plurality of circumferentially spaced holes or keyways, respectively corresponding to preset torque levels, and into which a key on a rotatable member may be inserted. A stop on the rotatable member is engageable with a portion of the locking structure to limit rotation. While this arrangement generally works satisfactorily, it has experienced a number of disadvantages in use.

The arrangement of the key and stop on the rotatable member are such that rotation is limited to approximately 180°, thereby necessarily limiting the number of preset positions that can be utilized. Further limiting the number of available positions is the fact that the diameter of the locking structure is limited by the inside diameter of the tubular lever arm. This limited available diameter also limits the size of the holes or keyways and, correspondingly the size of the key which fits therein. Accordingly, breakage of the key in use may result.

SUMMARY

There are disclosed herein an improved torque wrench and an improved torque preset selector mechanism and method which avoid the disadvantages of the aforementioned construction while affording additional structural and operating advantages.

In particular, there is described a torque wrench comprising an elongated lever arm having a working end and a distal end and a longitudinal axis and having an outer surface which is spaced transversely from the axis a distance no greater than a maximum transverse distance, a wrench head carried by the lever arm at the working end, torque-responsive mechanism carried by the lever arm, and a selector mechanism carried by the lever arm at the distal end and coupled to the torque-responsive mechanism for movement among a plurality of selectable positions respectively corresponding to plural preset torque values, the selector mechanism including retaining mechanism disposed axially beyond the distal end of the lever arm and being spaced transversely from the axis a distance greater than the maximum transverse distance for retaining the selector mechanism in a selected position.

There is also described a method of selecting one of a plurality of preset torque values in a torque wrench having a lever arm with a longitudinal axis and a selector mechanism thereon having selectable positions respectively corresponding to the preset torque values, the method comprising disposing a latching mechanism axially beyond a distal end of the lever arm so as not to be limited by lateral or transverse dimensions of the lever arm, and engaging the latching mechanism at a location laterally or transversely outboard of the lever arm so as to latch the selector mechanism in any selected one of its selectable positions.

BRIEF DESCRIPTION OF THE DRAWINGS

For the purpose of facilitating an understanding of the subject matter sought to be protected, there is illustrated in the accompanying drawings an embodiment thereof, from an inspection of which, when considered in connection with the following description, the subject matter sought to be protected, its construction and operation, and many of its advantages should be readily understood and appreciated.

DETAILED DESCRIPTION

Figure 1:
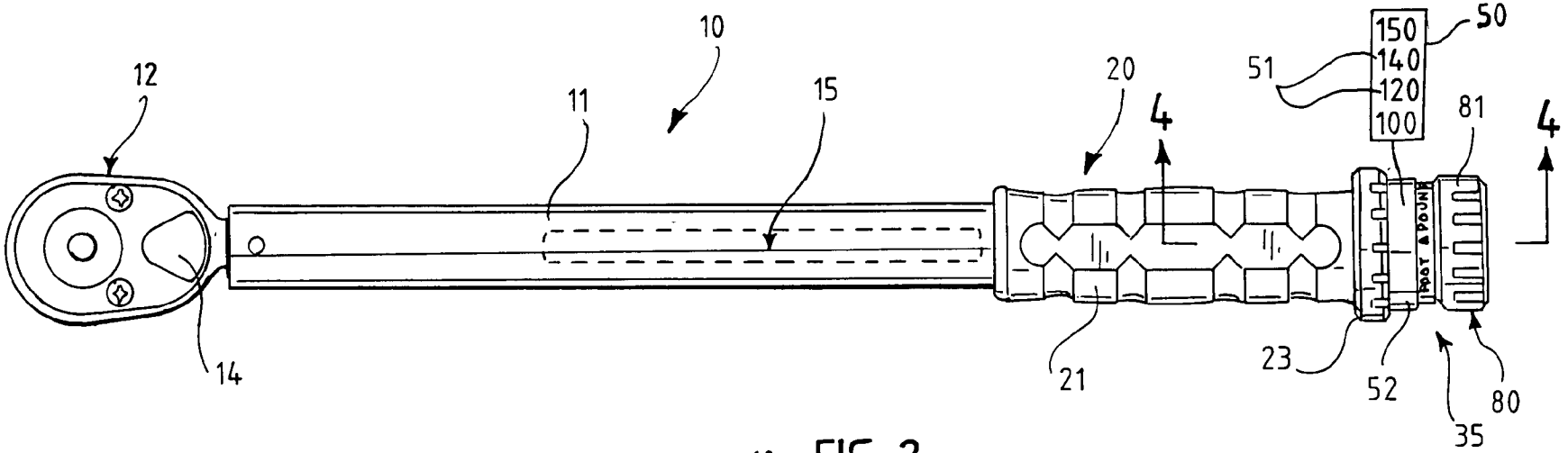
FIG. 1 is a top plan view of a torque wrench.
Figure 2:
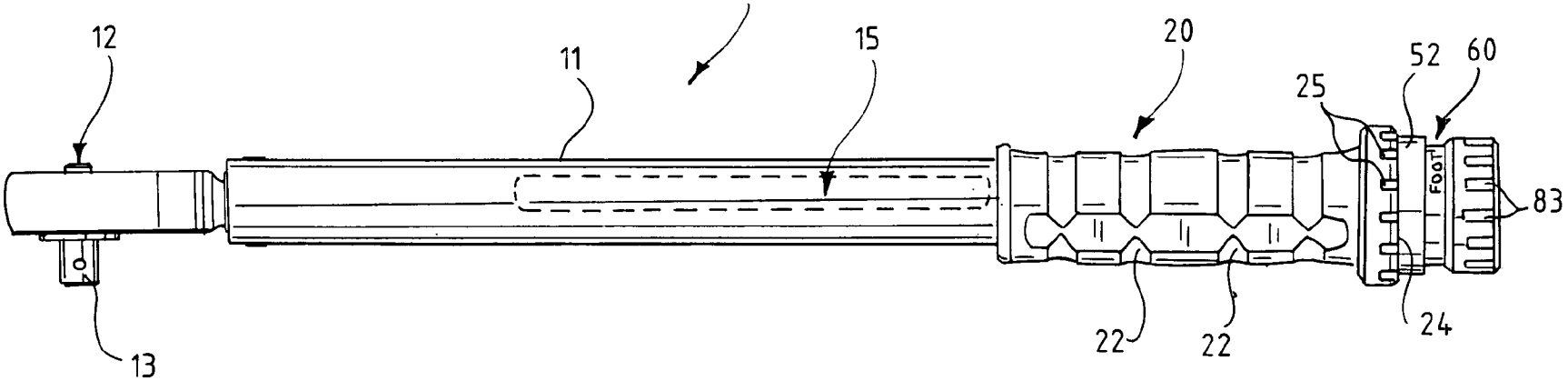
FIG. 2 is a front elevational view of the torque wrench of FIG. 1.

Referring to FIGS. 1 and 2, there is illustrated a torque wrench, generally designated by the numeral 10, having an elongated, tubular lever arm 11 having an outer surface with a maximum outer diameter which is constant along the length of the arm. Fixed to a working end of the lever arm 11 is a wrenching head 12 which, in the illustrated embodiment, is a ratchet head provided with a workpiece-engaging drive lug 13 and a reversing lever 14, and being of conventional construction. However, it will be appreciated that the wrench 10 could be used with any type of wrenching head. Carried by the lever arm 11 internally thereof is a torque-responsive mechanism 15, which is diagrammatically illustrated, and could be any of a number of known types. While the illustrated embodiment is a mechanical torque wrench designed to produce an audible and/or tactile indication when a predetermined torque level is reached, it will be appreciated that other known torque-responsive mechanisms could be utilized. The lever arm 11 terminates in a distal end face 17 (see FIG. 4) and is provided with a handle grip 20, including a tubular sleeve 21 telescopically covering the portion of the lever arm 11 adjacent to the distal end face 17, and having ergonomic gripping grooves or recesses 22 formed in the outer surface thereof. The sleeve 21 is integral at its distal end with a laterally or radially outwardly projecting annular flange 23 terminating in an annular end face 24 and providing along its outer surface with a plurality of circumferentially spaced recesses 25. Formed axially in the end face 24 is a cylindrical cavity 26 (see FIG. 4).

Figure 4:
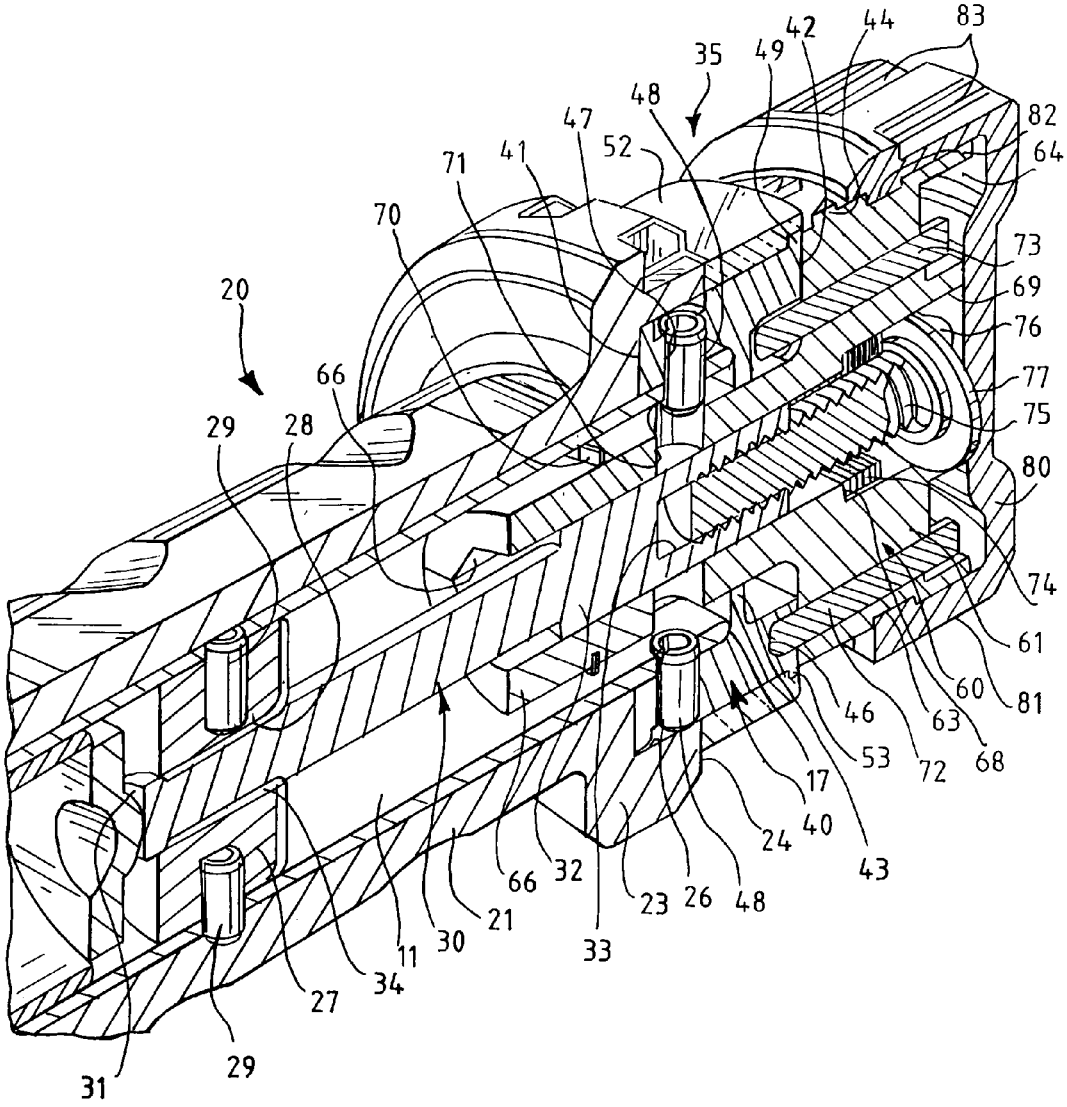
FIG. 4 is an enlarged, fragmentary, perspective sectional view, taken generally along the line 4—4 in FIG. 1.
Figure 5:
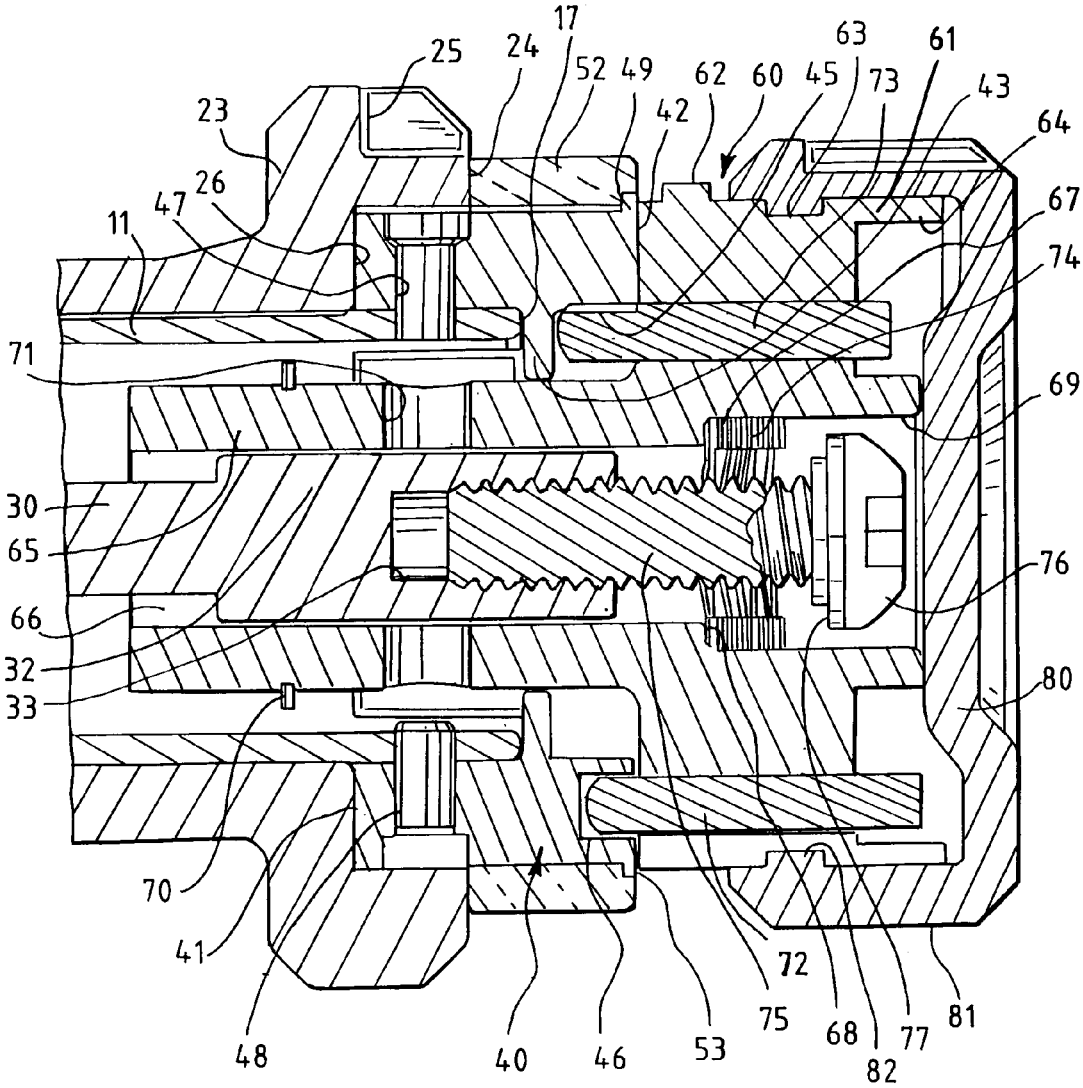
FIG. 5 is an elevational view of the right-hand portion of the section of FIG. 4.

Referring also to FIGS. 4 and 5, the wrench 10 includes a cylindrical nut 27 disposed within the tubular lever arm 11 and having an internally threaded bore 28 formed axially therethrough, being fixedly secured in place as by radial roll pins 29. The nut 27 forms part of a torque-adjusting mechanism, which also includes an elongated adjustment rod 30 having an inner end face 31 which is adapted for engagement with a portion of the associated torque-responsive mechanism 15, in a known manner. The adjustment rod 30 is provided at its rearward end with an enlarged portion 32 having an outer surface which is hexagonal in transverse cross section. Formed axially in the rear end face of the enlarged portion 32 is an internally threaded bore 33. The forward end of the adjustment rod 30 is externally threaded, as at 34, for threaded engagement with the nut 27 so that, as the adjustment rod 30 is rotated about its longitudinal axis, it moves axially forwardly or rearwardly relative to the nut 27 for adjusting a spring-tensioned torque-setting mechanism (not shown), all in a known manner.

Figure 6:
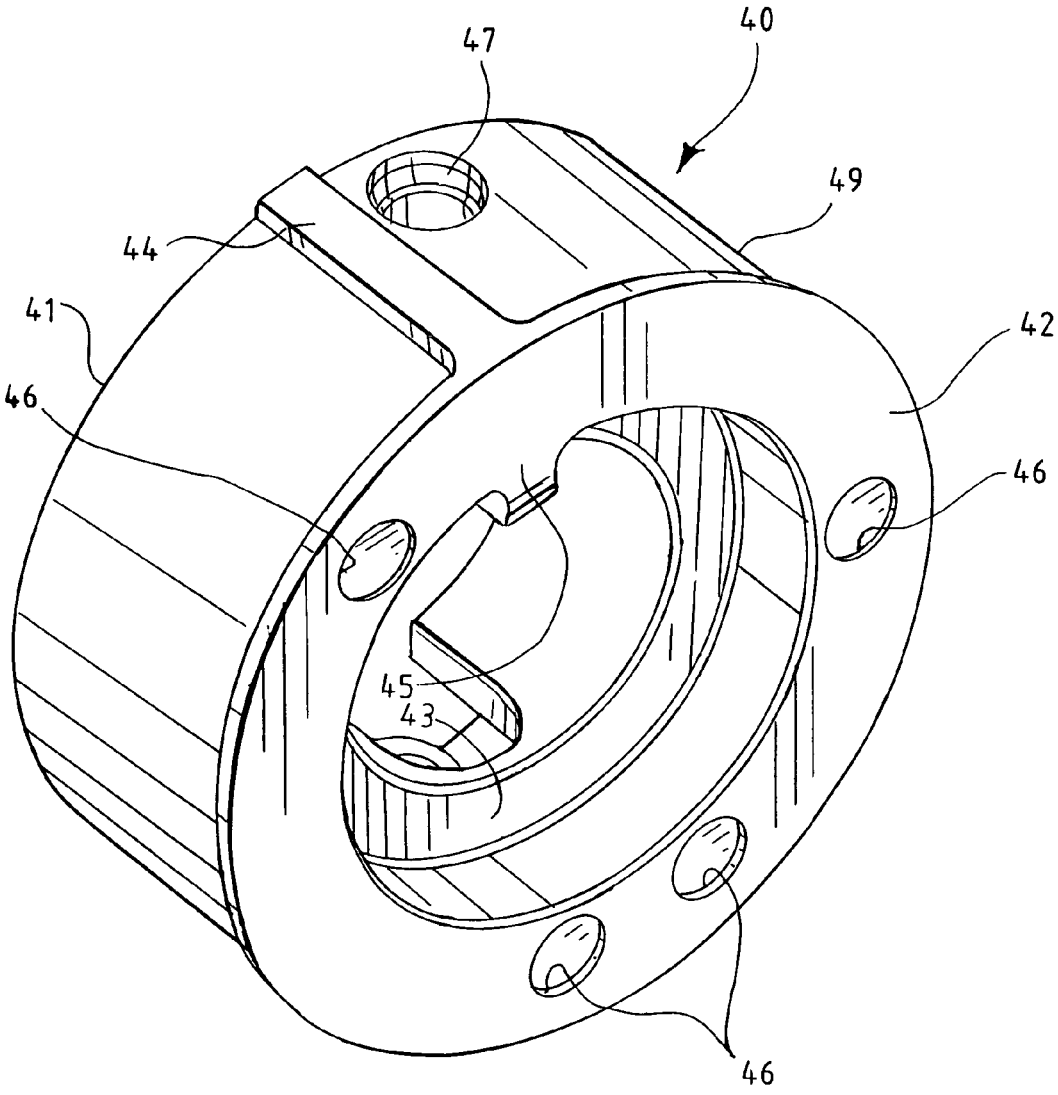
FIG. 6 is an enlarged, rear perspective view of a preset ring of the selector mechanism of the torque wrench of FIG. 1.

The wrench 10 includes a torque preset selector mechanism, generally designated by the numeral 35, which is adapted for cooperation with the adjustment rod 30 for manual movement among a plurality of positions respectively corresponding to preset torque values, and for automatically latching or retaining the mechanism 35 in the selected position. Referring now also to FIG. 6, the selector mechanism 35 includes a cylindrical preset ring 40, which is dimensioned and shaped to be installed in a mounted position, shown in FIGS. 4 and 5, telescopically encircling the distal end of the lever arm 11 and seated within the axial cavity 26 of the handle grip 20. The preset ring 40 has an annular front face 41 which abuts the handle grip flange 23 at the inner end of the cavity 26, and an annular rear face 42 which is disposed well rearwardly of the distal end face 17 of the lever arm 11 when the preset ring 40 is disposed in its mounted position. Projecting radially inwardly from the preset ring 40 intermediate its ends is an annular flange 43, which is disposed immediately adjacent to the distal end face 17 of the lever arm 11 when the preset ring 40 is disposed in its mounted position. Projecting radially outwardly of the preset ring 40 is an axially extending indicator rib 44 (see FIG. 6) which may be received in a complementary slot (not shown) in the cylindrical sidewall of the cavity 26. Projecting radially inwardly from the preset ring 40 in alignment with the indicator rib 44 is an axially extending stop rib 45. Formed in the rear face 42 of the preset ring 40 are a plurality of circumferentially spaced cylindrical preset holes 46, corresponding in number to the number of preset torque values desired. While four such holes are illustrated, it will be appreciated that any number could be provided. A radial bore 47 is formed through the preset ring 40 forwardly of the flange 43 for alignment with a corresponding bore through the lever arm 11 for receiving suitable roll pins 48 for fixing the preset ring 40 in place in its mounted position on the lever arm 11. The preset ring 40 is provided at its rearward end with a short, radially outwardly extending annular lip 49.

Figure 3:
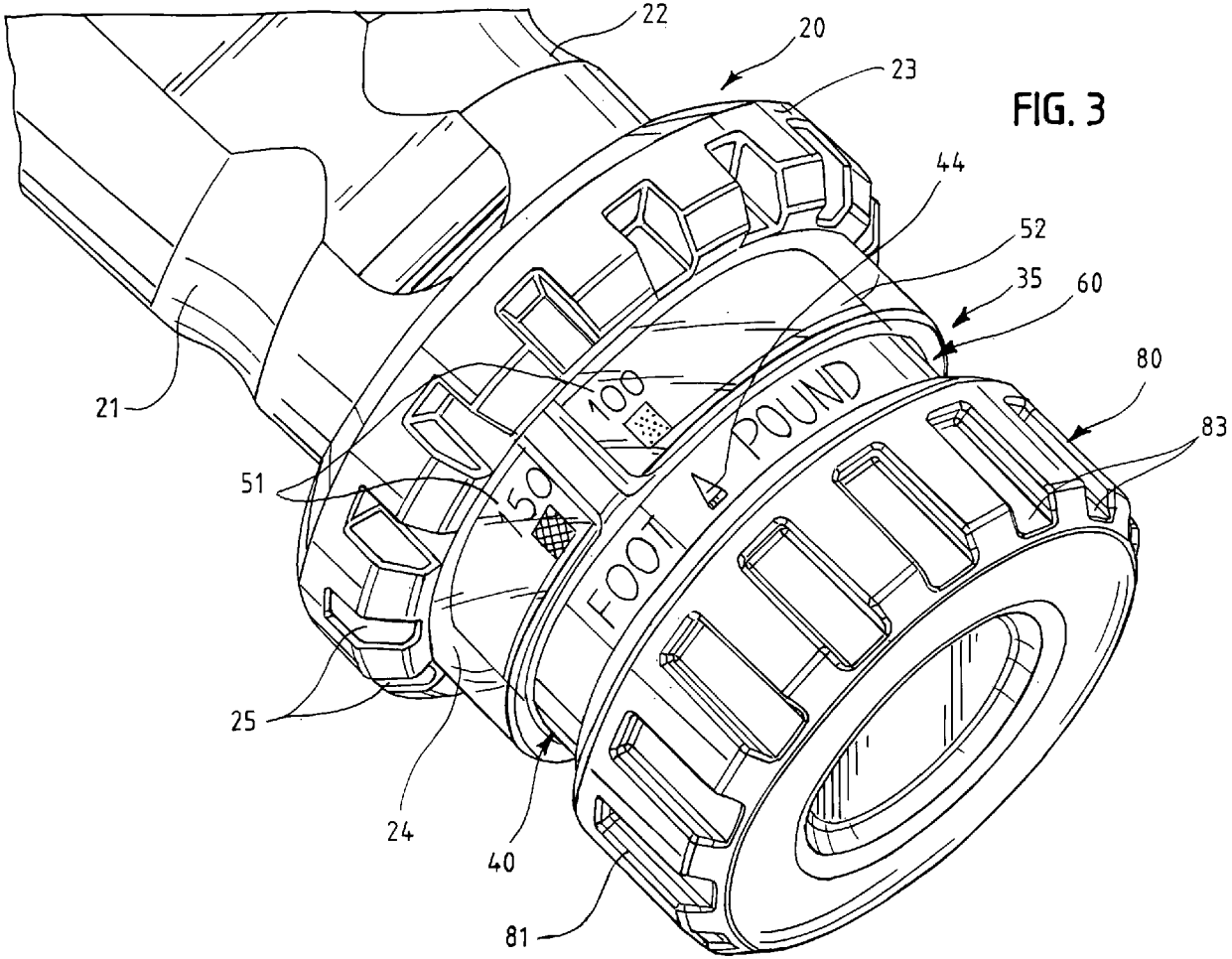
FIG. 3 is an enlarged, fragmentary, rear perspective view of the torque wrench of FIG. 1, showing the selector mechanism.

An indicator label 50 (see FIG. 1) may be applied to the outer surface of the preset ring 40 between the lip 49 and the end face 24 of the handle grip flange 23, the label 50 bearing indicia 51 corresponding respectively to the different preset torque values. The indicator rib 44 designates the location at which the label should be applied so that the indicia locations accurately correspond to the positions of the preset holes 46. Referring also to FIG. 3, a protective collar 52, which may be formed of a clear plastic material, overlies the label 50 to protect it in use while permitting viewing of the indicia 51, the collar 52 having an annular groove 53 formed in its rearward inner surface for seating against the lip 49. It will be appreciated that the collar 52 is also provided with a slot (not shown) in its inner surface to accommodate the indicator rib 44.

The selector mechanism 35 also includes a generally cylindrical selector knob 60, having a main body 61 with a pointer rib 62 projecting radially outwardly from the outer surface thereof and having an annular groove 63 formed in the outer surface rearwardly of the pointer groove 62. Formed in the rear end face of the main body 61 is an annular cavity 64. Projecting forwardly from the main body 61, coaxial therewith, is a tubular portion 65 which fits coaxially within the lever arm 11 and is provided with an inner surface 66 which is hexagonal in transverse cross section for mateably receiving the enlarged hexagonal portion 32 of the adjustment rod 30. Formed in the rear end face of the main body 61 is an axial bore 67 which communicates with the hexagonal cavity at an annular shoulder 68, the rearward end of the bore 67 having an inner surface 69 which is hexagonal in transverse cross section. Seated in a complementary annular groove in the outer surface of the tubular portion 65 is a radially outwardly projecting C-clip 70. A radial bore 71 is formed diametrically through the tubular portion 65 rearwardly of the clip 70. Fixed, as by press fitting, in a bore in the main body 61 extending parallel to the longitudinal axis of the knob 60 is a preset pin 72, which projects forwardly of the main body 61. Also seated, as by press fitting, in another bore in the main body 61 disposed at a diametrically opposed location from the preset pin 72, is a stop pin 73 which is disposed substantially parallel to the preset pin 72 and extends forwardly of the main body 61 slightly further than the preset pin 72.

A bias spring 74 is seated in the axial bore 67 against the shoulder 68, and may be in the nature of a helical wave-type spring. A screw 75 has its shank extending coaxially through the spring 74 and threadedly engaged in the axial bore 33 of the adjustment rod 30, the screw having an enlarged hexagonal head 76 adapted to mateably fit within the hexagonal inner surface 69 of the axial bore 67. The screw 75 may be provided with a washer 77 against which the rearward end of the spring 74 seats.

The selector knob 60 is provided with a cup-shaped cap 80, which may be formed of a suitable gripping material, such as a suitable flexible and resilient plastic material. The cap 80 has a forwardly projecting, cylindrical flange 81 provided adjacent to its forward end with a radially inwardly projecting annular rib 82, dimensioned so that the flange 81 can be snap-fitted over the rear end of the selector knob main body 61, with the rib 82 snap-fitting into engagement with the annular groove 63.

It can be seen that, when the parts are assembled in the manner shown in FIGS. 3–5, the tubular portion 65 of the selector knob 60 fits coaxially within the lever arm 11, the selector knob 60 being resiliently urged forwardly by the spring 74. The stop pin 73 rides within the preset ring 40, being engageable with the opposite sides of the stop rib 45 for limiting rotational movement of the selector knob 60 relative to the preset ring 40, this movement extending through approximately 340°. When it is desired to select a preset torque value, the selector knob 60 is pulled rearwardly against the urging of the spring 74 until the forward end of the preset pin 72 clears the rear face 42 of the preset ring 40, permitting free rotation of the selector knob 60. When the knob 60 has been rotated to the desired position, indicated by alignment of the pointer rib 62 with the selected one of the indicia 51, the selector knob 60 is released and driven forwardly by the spring 74 to seat the preset pin 72 in the selected one of the preset holes 46, the main body 61 of the selector knob 60 being stopped against the rear face 42 of the preset ring 40. Thus, the preset pin 72 and the preset holes 46 cooperate to form a latching or retaining mechanism to latch or retain the selector mechanism 35 and, in particular, the selector knob 60, in its selected position. Because of the different forward extents of the preset pin 72 and the stop pin 73, the stop pin 73 will remain within the preset ring 40 during rotation of the selector knob 60. It will be appreciated that, as the selector knob 60 is rotated, the adjustment rod 30 and the screw 75 rotate with it as a unit, by reason of the engagement of the hex head 76 of the screw with the hexagonal portion 69 of the axial bore 67 and engagement of the hexagonal portion 32 of the adjustment rod 30 with the hexagonal inner surface 66 on the selector knob 60. The rotation of the adjustment rod 30 causes it to move axially, by reason of the threaded engagement with the fixed nut 27, as described above, for adjusting the preset force on the torque-responsive mechanism 15 to correspond to the selected preset torque level.

The C-clip 70 is engageable with the annular flange 43 of the preset ring 40 to prevent axial removal of the selector knob 60. If it is desired to disassemble the parts, the preset ring 40 must first be removed, which requires removal of the pins 48. For this purpose, the handle grip 20 is pulled forwardly to expose the pins 48. The selector knob 60 is then rotated until the radial bore 71 is in alignment with the pins 48 and the screw 75 is backed off sufficiently so that the pins 48 can then be pushed radially inwardly into the bore 71 to free the preset ring 40.

Because the latching or retaining mechanism resulting from the cooperation between the preset pin 72 and the preset holes 46 is disposed axially beyond the distal end face 17 of the lever arm 11, the imaginary circle which passes through the centers of the preset holes 46 may have a diameter greater than the maximum outer diameter of the tubular lever arm 11. In other words, the preset holes 46 and the preset pin 72 may be disposed laterally or radially outboard of the lever arm 11. This permits an increased number of preset holes 46 to be utilized, as compared with prior devices wherein the selector mechanism was disposed within the lever arm 11, and also permits the use of increased-diameter preset holes 46 and correspondingly increased-diameter preset pin 72. This greatly reduces the chance of breakage of the preset pin in use.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of applicants' contribution. The actual scope of the protection sought is intended to be defined in the following claims when viewed in their proper perspective based on the prior art.

What is claimed is:

1. A torque wrench comprising:

an elongated lever arm having a working end and a distal end and a longitudinal axis and having an outer surface which is spaced transversely from the axis a distance no greater than a maximum transverse distance, a wrench head carried by the lever arm at the working end, torque-responsive mechanism carried by the lever arm, and a selector mechanism carried by the lever arm at the distal end and coupled to the torque-responsive mechanism for movement among a plurality of selectable positions respectively corresponding to plural preset torque values, the selector mechanism including a retaining mechanism and a preset ring coaxial with the axis, said retaining mechanism disposed axially beyond the distal end of the lever arm and being spaced transversely from the axis a distance greater than the maximum transverse distance for retaining the selector mechanism in a selected position, wherein the selector mechanism is axially engageable with the ring and rotatable relative to ring about the axis, the selector mechanism including an axially extending pin and the ring including a plurality of circumferentially spaced and axially extending holes for receiving the pin.

2. The wrench of claim 1, wherein the selector member is axially movable relative to the ring between a locked condition preventing relative rotation and an unlocked condition permitting relative rotation.

3. The wrench of claim 2, and further comprising bias means resiliently urging the selector mechanism to its locked condition.

4. A torque wrench comprising:

an elongated lever arm having a working end and a distal end and a longitudinal axis and having an outer surface which is spaced transversely from the axis a distance no greater than a maximum transverse distance, a wrench head carried by the lever arm at the working end, torque-responsive mechanism carried by the lever arm, a selector mechanism carried by the lever arm at the distal end and coupled to the torque-responsive mechanism for movement among a plurality of selectable positions respectively corresponding to plural preset torque values, the selector mechanism including a retaining mechanism and a preset ring coaxial with the axis, said retaining mechanism disposed axially beyond the distal end of the lever arm and being spaced transversely from the axis a distance greater than the maximum transverse distance for retaining the selector mechanism in a selected position, wherein the selector mechanism is rotatable relative to ring about the axis; and a first stop structure on the ring and a second stop structure on the selector mechanism for limiting relative rotational movement.

5. The wrench of claim 4, wherein the first stop structure extends radially inwardly of the ring and the second stop structure extends axially from the selector member within the ring for engagement with opposite sides of the first stop structure for defining end points of a range of rotational movement of at least 300°.

* * * * *